US006575366B2

(12) United States Patent
Kobayashi

(10) Patent No.: US 6,575,366 B2
(45) Date of Patent: Jun. 10, 2003

(54) GAME MACHINE USING SELF-PROPELLED MEMBER

(75) Inventor: Yusuke Kobayashi, Tokyo (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 10/106,216

(22) Filed: Mar. 27, 2002

(65) Prior Publication Data

US 2002/0139854 A1 Oct. 3, 2002

(30) Foreign Application Priority Data

Mar. 28, 2001 (JP) ..... 2001-091852

(51) Int. Cl.[7] ..... G06K 7/10

(52) U.S. Cl. ..... 235/462.01; 235/462.08; 235/162.09; 235/462.1; 235/462.2

(58) Field of Search ..... 235/462.01, 462.08, 235/462.09, 462.1, 462.45, 462.2

(56) References Cited

U.S. PATENT DOCUMENTS 4,906,843 A * 3/1990 Jones et al. ..... 250/221
5,814,804 A * 9/1998 Kostizak ..... 235/472.01
5,924,927 A * 7/1999 Matsuura et al. ..... 463/62
6,036,094 A * 3/2000 Goldman et al. ..... 235/462.45
6,244,511 B1 * 6/2001 Vandenberg et al. ... 235/462.45

FOREIGN PATENT DOCUMENTS

| | | |
|---|---|---|
| JP | 2645851 | 5/1997 |
| JP | 2650643 | 5/1997 |
| JP | 2861978 | 12/1998 |
| JP | 11-244517 | 9/1999 |

* cited by examiner

*Primary Examiner*—Michael G. Lee
*Assistant Examiner*—Steven S. Paik
(74) *Attorney, Agent, or Firm*—Sughrue Mion, PLLC

(57) ABSTRACT

A plurality of two-dimensional bar codes are arranged on a traveling plane in a game machine. A self-propelled member travels on the traveling plane so as to trace a programmed traveling path. A bar code reader is provided in the self-propelled member, for reading information provided with each two-dimensional bar code. A position information processor detects a travel position of the self-propelled member in accordance with the information read by the bar code reader, and controls a movement of the self-propelled member in accordance with the detected travel position.

11 Claims, 3 Drawing Sheets

GAME MACHINE USING SELF-PROPELLED MEMBER

BACKGROUND OF THE INVENTION

The present invention relates to a game machine, and more particularly, to a position sensor for sensing the position of a self-propelled member employed in a racing game machine or the like. Further, the present invention enables not only simplification of a position sensor which senses the every-changing position of a self-propelled member on a traveling field (i.e., a two-dimensional plane) for controlling trackless travel of the self-propelled member through feedback, but also simplification of computation processing for sensing position information.

A game machine for causing miniatures to travel in cooperation with traveling of self-propelled members includes a racing game machine for causing miniatures to race with each other, a play game machine for causing a miniature to perform various actions, and the like. Of the game machines, some employ a self-propelled member as a miniature; some employ a two-storied structure; and some guide a miniature through use of a self-propelled member. In terms of a travel control method, some game systems control a self-propelled member which is essentially to travel in a trackless manner, through feedback (as described in; e.g., Japanese Patent No. 2861978), and some game systems control a member which is essentially to travel while tracking down a guide line, so as not to deviate from the guide line through feedback (as described in; e.g., Japanese Patent Publication No. 11-244517A).

A game machine which causes a self-propelled member to travel in a trackless manner controls a traveling path of a self-propelled member and an every-changing travel speed of the same in accordance with a program through feedback. The every-changing position of the self-propelled member on a traveling field (two-dimensional plane) is detected, and the traveling path and speed of the self-propelled member are feedback-controlled on the basis of position information.

There are various techniques for controlling trackless travel of a member in a game machine. The outline of a typical position sensor for effecting feedback control is shown in FIG. 1. In the position sensor shown in FIG. 1, X-position sensing lines 2*a* and Y-position sensing lines 2*b* are densely provided within the traveling field 1. The X-position sensing lines 2*a* are connected to an X-position retriever 3*a*, and the Y-position sensing lines 2*b* are connected to a Y-position retriever 3*b*. In this way, a self-propelled member travels over the traveling field 1 within which the X-position sensing lines 2*a* and the Y-position sensing lines 2*b* are arranged. The self-propelled member emits a unique signal from its transmitter. The position sensing lines 2*a* and 2*b* receive the unique signal and send the thus-received signal to the X-axis and Y-position retrievers 3*a* and 3*b*. The received signal is further transmitted to a position detector 4, where the X-coordinate position and Y-coordinate position of the self-propelled member are detected by the position detector 4. The position detecting signal is transmitted to a microcomputer 5. Since the self-propelled member emits a unique signal at predetermined time intervals, the traveling position of the self-propelled member is detected every time the unique signal is emitted.

In the case of a game machine which senses the position of a self-propelled member through use of the position sensing lines 2*a* and 2*b*, since the position sensing lines 2*a* and 2*b* are arranged within the traveling field 1 densely, manufacturing costs of the game machine are expensive. Laborious operations are required for laying sensing lines within a traveling field. Further, there may arise a case where malfunction may arise for reasons of an open circuit or connection failures. In this case, a plurality of position sensing lines located in the vicinity of one self-propelled member receive signals output from the self-propelled member. Hence, the position sensing lines closest to the self-propelled member are discriminated by the position retrievers 3*a* and 3*b* so that the traveling position of the self-propelled member is detected from the signal received by the closest position sensing lines. For this reason, information processing required for effecting position detecting operation is not simple. As mentioned above, this related position sensor is complicated in both hardware and software.

SUMMARY OF THE INVENTION

The present invention is aimed at simplifying a sensor for detecting the travel position of a self-propelled member in a game machine and putting considerable thought into a position sensor by utilization of a recent sophisticated information processing and reading technique such that information about the position of a self-propelled member on a traveling field can be read directly.

In order to achieve the above object, according to the present invention, there is provided a game machine, comprising:

- a traveling plane, on which a plurality of two-dimensional bar codes are arranged;
- a self-propelled member, which travels on the traveling plane so as to trace a programmed traveling path;
- a bar code reader, provided in the self-propelled member, for reading information provided with each two-dimensional bar code; and
- a position information processor, which detects a travel position of the self-propelled member in accordance with the information read by the bar code reader, and controls a movement of the self-propelled member in accordance with the detected travel position.

A two-dimensional bar code itself has hitherto been known, and a minute two-dimensional bar code which represents predetermined position information through use of a code are arranged in a matrix pattern systematically. Regardless of the direction of a two-dimensional bar code relative to the scanning direction of a two-dimensional bar code reader, code information can be read momentarily without fail. Further, the thus-read code information per se represents the position of the self-propelled member. Hence, information processing required for reading positional information is simple.

Since the printed two-dimensional bar code is scanned by the bar code reader, thereby reading code information representing positional information, a position sensor mechanism can be made considerably simple. Still further, since a read precision of this system is very high, there are substantially no position information read errors. Consequently, costs incurred for manufacturing a position sensor are considerably curtailed in terms of hardware and software.

Preferably, a sheet member on which the two-dimensional bar codes are printed is placed on the traveling field.

In this configuration, an operation required for providing the bar codes is also very simple.

Preferably, the bar code reader reads the information in response to an instruction which is intermittently issued from the position information processor.

Alternatively, it is preferable that the bar code reader reads the information in response to an instruction which is periodically issued from a timer provided with the self-propelled member.

The position information processor may be provided inside or outside of the self-propelled member.

Preferably, the two-dimensional bar codes, each having a substantially square shape, are arranged with a fixed interval which is about twice a side constituting the square.

Since space is interposed between two-dimensional bar codes, occurrence of a failure to read code information can be avoided.

Preferably, each two-dimensional bar code is covered with a transparent resin sheet having a wrinkled surface.

In this configuration, the bar code is protected from friction which arises between drive wheels of the self-propelled member and the bar codes. Hence, abrasion of and damage to the bar code images are surely prevented. Further, the wrinkled sheet surface has a high frictional coefficient. Hence, slippage of wheels of a self-propelled member can be diminished, thereby improving the precision of travel control operation.

If a material of the resin sheet has a high frictional coefficient, the surface may not be wrinkled. Alternatively, the surface frictional coefficient of the resin sheet can be increased by roughening such as satin finishing.

Here, the two-dimensional bar codes may be printed on a lower surface of the resin sheet.

Preferably, a pair of bar code readers are provided in a front lower portion and a rear lower portion of the self-propelled member, respectively.

In this configuration, since code information about two two-dimensional bar codes can be read simultaneously through use of the pair of bar code readers, the orientation of the self-propelled member can be readily detected on the basis of the thus-detected two code information items. Consequently, control of a traveling path, including an operation for turning a self-propelled member at a target point on a scheduled traveling path, becomes simple.

Here, it is preferable that the two-dimensional bar codes are arranged with a fixed interval which is smaller than a distance between the pair of bar code readers.

Preferably, each two-dimensional bar code indicates a position where the bar code situates on the traveling field, which is represented by an X-coordinate position and a Y-coordinate position.

In this configuration, information processing required for detecting the position of the self-propelled member can be made simple.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of the invention will now be described by reference to the accompanying drawings.

Figure 1:
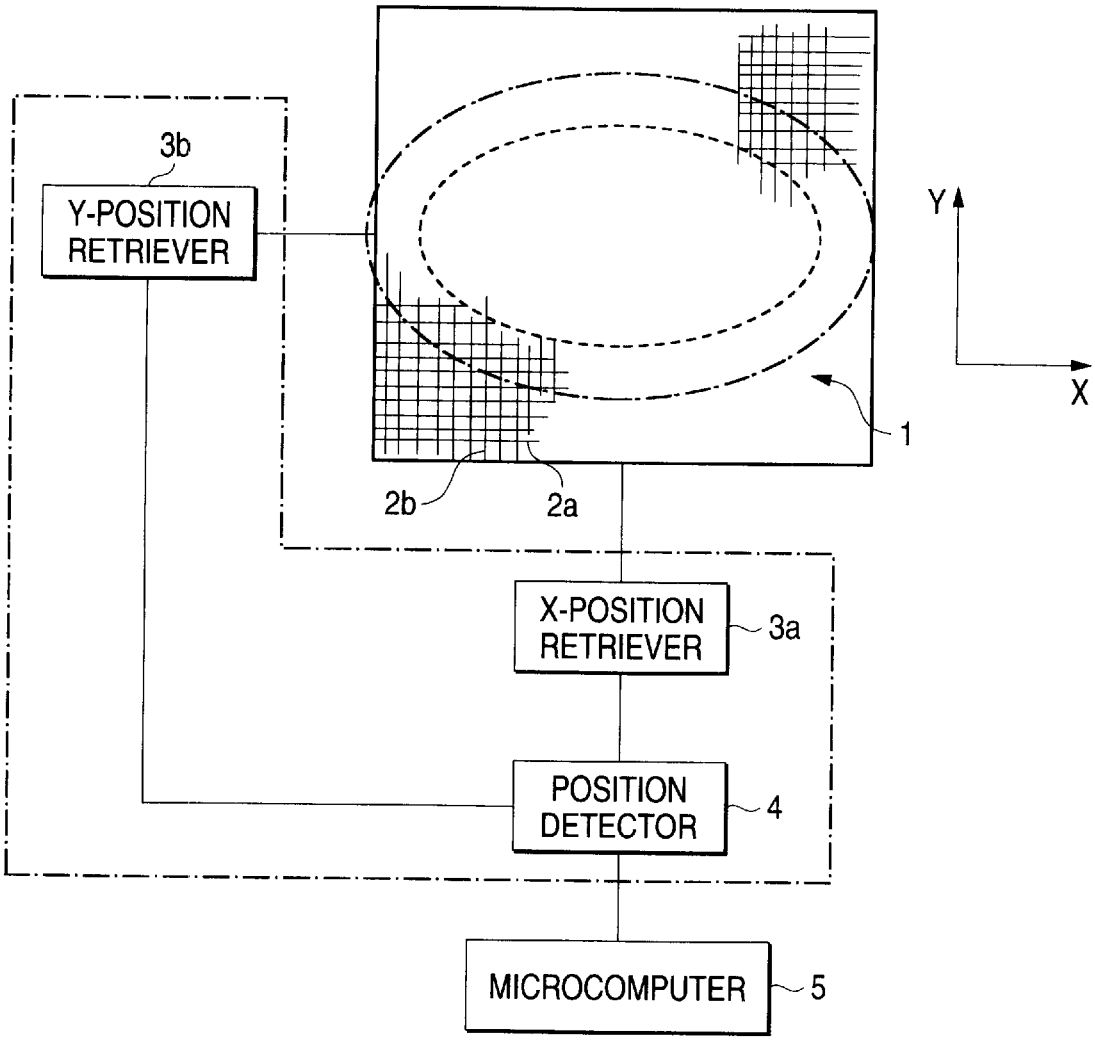
FIG. 1 is a block diagram showing a position sensor of a self-propelled member provided in a related game machine.
Figure 2:
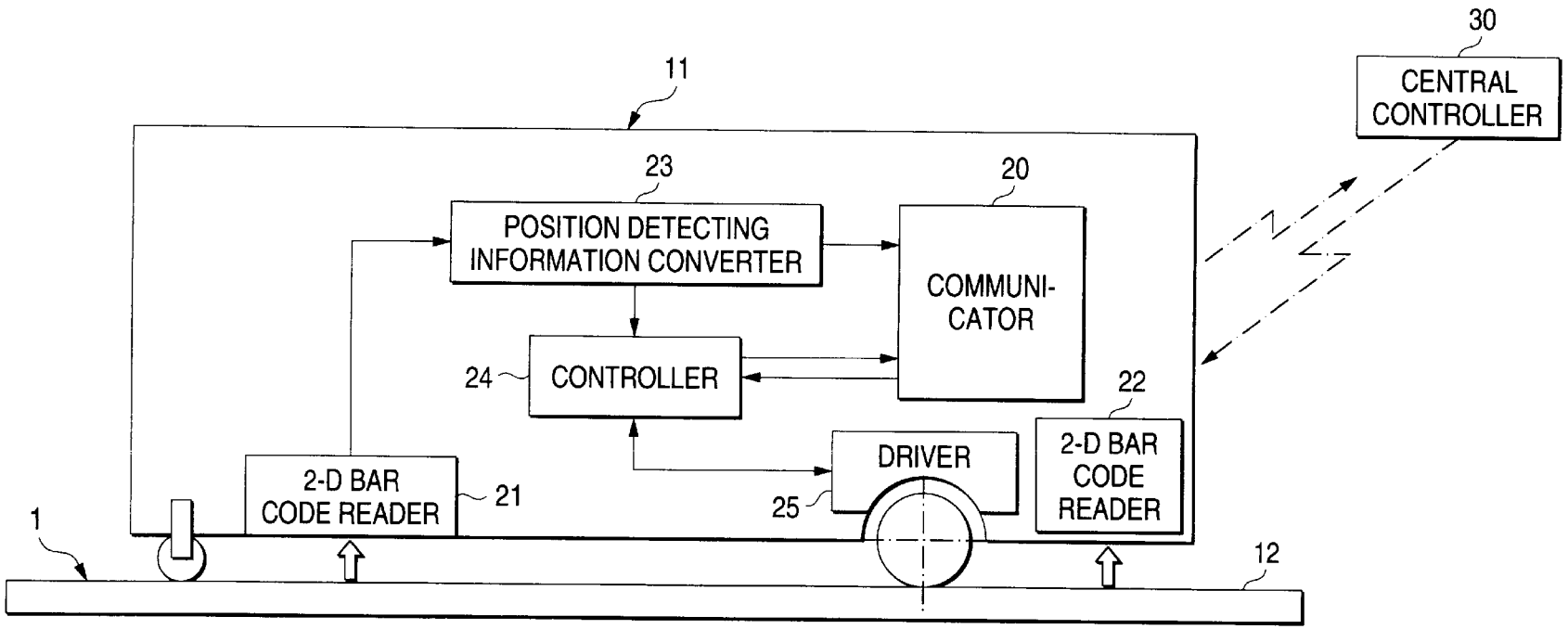
FIG. 2 is a side-elevation view of the self-propelled member according to one embodiment of the present invention.

A self-propelled member 11 shown in FIG. 2 is analogous to a self-propelled member or a self-propelled member equipped with a miniature, which member is to be employed in a two-storied game machine such as that described in; e.g., Japanese Patent Nos. 2650643 and 2645851. Travel of the self-propelled member 11 is controlled along and at a programmed traveling path and speed in accordance with every-changing position information, through feedback.

Figure 3:
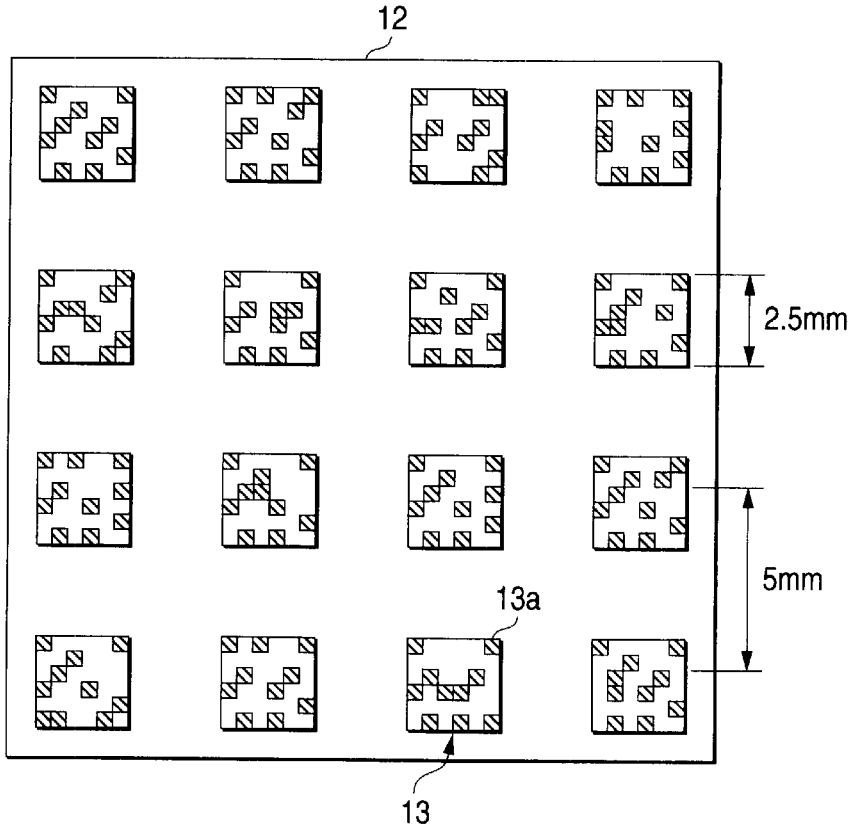
FIG. 3 is an enlarged plan view of a two-dimensional bar code according to the embodiment.

In this embodiment, a two-dimensional bar code sheet 12 is laid on a traveling field 1. A plurality of two-dimensional bar codes 13 are printed at given intervals on the two-dimensional bar code sheet 12. FIG. 3 schematically shows enlarged two-dimensional bar codes 13. In the example, each of the two-dimensional bar codes 13 is a square of 2.5 mm. The two-dimensional bar codes 13 are arranged at a pitch of 5 mm. A plurality of marks 13*a* are arranged on an individual two-dimensional bar code 13 so as to follow a predetermined rule. Single code information is displayed by combination of a plurality of marks 13*a*.

A two-dimensional bar code reader 21 is provided in a forward position on the lower face of the self-propelled member 11. The two-dimensional bar code reader 21 reads code information represented by the two-dimensional bar codes 13 (as indicated by a bold arrow). The two-dimensional bar code reader 21 reads two-dimensional bar codes 13 in accordance with a position reading instruction output from a central controller 30 and received through a communicator 20. A position information converter 23 converts the read code information into position information, and the position information is then transmitted to the central controller 30 through the communicator 20. In accordance with the position information, the central controller recognizes the every-changing position of the self-propelled member 11. The thus-ascertained position of the self-propelled member 11, feedback control with respect to a driver 25 is effected through the communicator 20 and a controller 24. Hence, information processing required for effecting feedback control is simplified.

The X-coordinate position of the self-propelled member 11 on the traveling field is represented by half the number of bits constituting code information about a two-dimensional bar code (e.g., 16 bits). The Y-coordinate position of the same is represented by use of the remaining bits. Code information per se can also be made so as to directly represent the X- and Y-coordinate positions of a self-propelled member. As in the case of a racing game machine, if a traveling field is wide and a considerably large number of two-dimensional bar codes are employed, it is practical to obtain position information by means of converting code information in a position information converter.

In the case of the present embodiment, an individual bar code 13 is constituted into a square of 2.5 mm, and the bar codes 13 are arranged at a pitch of 5 mm. Hence, the two-dimensional bar codes 13 are arranged densely. Consequently, feedback control to be effected during travel control can be made intricate.

The size of a pitch between the two-dimensional bar codes is relevant to the magnitude of an error of feedback control of a traveling path. As a pitch becomes greater, the error becomes greater. Hence, in actual design, the pitch must be determined in consideration of such a relevancy.

In relation to steering control of a self-propelled member in a racing game machine, there is a necessity of detecting the orientation of a self-propelled member in two-dimensional coordinates as well as the position of the self-propelled member in two-dimensional coordinates. In the present embodiment, in addition to the two-dimensional bar code reader 21 for position sensing purpose, a two-dimensional bar code reader 22 is provided in a rear portion of the self-propelled member. Hence, the density of two-dimensional bar codes must be set such that the two-dimensional bar code readers 21 and 22 can read different two-dimensional bar codes concurrently.

Since a two-dimensional square bar code of smaller than 1 mm has already been put into practice, no problem may be encountered in making the two-dimensional bar codes 13 and the pitch, which are to be employed actually, smaller than those employed in the present embodiment.

Preferably, each two-dimensional bar code is covered with a transparent resin sheet (not shown) having a wrinkled surface.

In this configuration, the bar code is protected from friction which arises between drive wheels of the self-propelled member and the bar codes. Hence, abrasion of and damage to the bar code images are surely prevented. Further, the wrinkled sheet surface has a high frictional coefficient. Hence, slippage of wheels of a self-propelled member can be diminished, thereby improving the precision of travel control operation.

If a material of the resin sheet has a high frictional coefficient, the surface may not be wrinkled. Alternatively, the surface frictional coefficient of the resin sheet can be increased by roughening such as satin finishing.

Here, the two-dimensional bar codes may be printed on a lower surface of the resin sheet.

Figure 4:
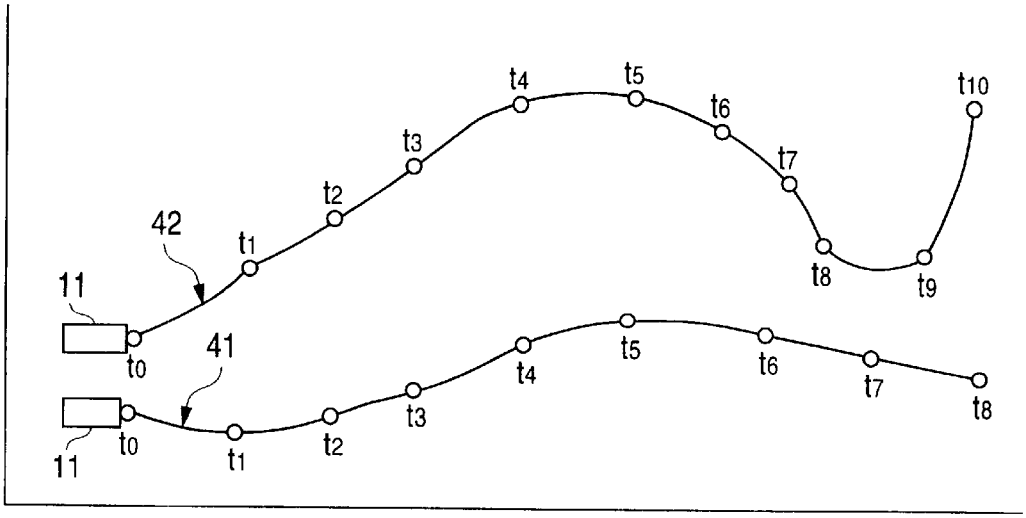
FIG. 4 is a diagram for explaining a trackless traveling control according to the embodiment.

The position sensor effects travel control operation in the manner as schematically shown in FIG. 4. The travel control is identical with trackless travel control performed in the related art. On the basis of a programmed travel route and speed, the self-propelled member is caused to travel from a target point $t_1$ to $t_2$ along a scheduled traveling path 41 or 42. At a target point $t_2$, the position sensor receives a position detecting instruction and reads code information from a two-dimensional bar code located at the target point $t_2$. The thus-read code information is transmitted to the central controller 30. The central controller 30 computes the amount of difference in both the X and Y directions between the code information and the programmed target point $t_2$. A result of computation is fed back to the driver 25, thereby causing the self-propelled member 1 to travel toward the next target point $t_3$ while controlling a traveling direction and speed. In this way, the central controller 30 causes the self-propelled member 11 to sequentially follow target points $t_4$ through $t_{10}$. As a result, the self-propelled member 11 travels along the predetermined traveling path 41 or 42 at a predetermined speed. Control of the traveling direction of the self-propelled member 11 is performed by imparting a difference to the rotational speed of the left drive wheel and the rotational speed of the right drive wheel, through the driver 25. The orientation of the self-propelled member 11 at that time is computed on the basis of code information read by the two-dimensional bar codes 21 and 22. The turning angle of the self-propelled member 11 is computed from the orientation of the self-propelled member 11 at that time and the next target point. To this end, a difference between the rotational speed of the left drive wheel and that of the right drive wheel is computed. Such steering control is identical with that employed in the related art and has widely been known. The technique falls outside the scope of the present invention, and hence its detailed explanations are omitted.

When the position sensor according to the present invention is applied to a game machine employing a self-propelled member having a self-complete travel controller, control data are stored in control memory of the travel controller of the self-propelled member. On the basis of the control data, feedback control is effected in a self-complete manner by position sensing information detected in the manner mentioned above. In this case, travel control information can be collectively stored in the control memory on a per-game basis. Alternatively, travel control data for one game can be received several times. As an alternative, control information about a plurality of games can be stored collectively.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A game machine, comprising:

a traveling plane, on which a plurality of two-dimensional bar codes are arranged;

a self-propelled member, which travels on the traveling plane so as to trace a programmed traveling path;

a bar code reader, provided in the self-propelled member, for reading information provided with each two-dimensional bar code; and a position information processor, which detects a travel position of the self-propelled member in accordance with the information read by the bar code reader, and controls a movement of the self-propelled member in accordance with the detected travel position.

2. The game machine as set forth in claim 1, wherein the bar code reader reads the information in response to an instruction which is intermittently issued from the position information processor.

3. The game machine as set forth in claim 1, wherein the two-dimensional bar codes, each having a substantially square shape, are arranged with a fixed interval which is about twice a side constituting the square.

4. The game machine as set forth in claim 1, wherein each two-dimensional bar code is covered with a transparent resin sheet having a wrinkled surface.

5. The game machine as set forth in claim 1, wherein a pair of bar code readers are provided in a front lower portion and a rear lower portion of the self-propelled member, respectively.

6. The game machine as set forth in claim 5, wherein the two-dimensional bar codes are arranged with a fixed interval which is smaller than a distance between the pair of bar code readers.

7. The game machine as set forth in claim 1, wherein each two-dimensional bar code indicates a position where the bar code situates on the traveling field, which is represented by an X-coordinate position and a Y-coordinate position.

8. The game machine as set forth in claim 1, further comprising an upper stage extending above the traveling field, on which a miniature member travels while being guided by the self-propelled member through a magnetic force.

9. The game machine as set forth in claim 1, wherein the bar code reader reads the information in response to an instruction which is periodically issued from a timer provided with the self-propelled member.

10. The game machine as set forth in claim 1, wherein a sheet member on which the two-dimensional bar codes are printed is placed on the traveling field.

11. A game machine, comprising:

a traveling plane;

a transparent resin sheet covering the traveling plane having a wrinkled upper surface;

a plurality of two-dimensional bar codes printed on a lower surface of the resin sheet;

a self-propelled member, which travels on the traveling plane so as to trace a programmed traveling path;

a bar code reader, provided in the self-propelled member, for reading information provided with each two-dimensional bar code; and a position information processor, which detects a travel position of the self-propelled member in accordance with the information read by the bar code reader, and controls a movement of the self-propelled member in accordance with the detected travel position.

* * * * *